US009016935B2

(12) United States Patent
Kaltenrieder et al.

(10) Patent No.: US 9,016,935 B2
(45) Date of Patent: Apr. 28, 2015

(54) WATCH WITH TACTILE ZONES OF CAPACITIVE TYPE COMPRISING A BATTERY HATCH CLOSED BY AN ELECTRICALLY CONDUCTING COVER

(75) Inventors: Andre Kaltenrieder, Preles (CH); Jean-Luc Bovet, Solothum (CH); Christian Racine, Malleray-Bevilard (CH); Sergio Rota, Colombier (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 0 days.

(21) Appl. No.: 13/878,517

(22) PCT Filed: Oct. 17, 2011

(86) PCT No.: PCT/EP2011/068118

§ 371 (c)(1),
(2), (4) Date: Apr. 9, 2013

(87) PCT Pub. No.: WO2012/076225

PCT Pub. Date: Jun. 14, 2012

(65) Prior Publication Data

US 2013/0201803 A1 Aug. 8, 2013

(30) Foreign Application Priority Data

Dec. 7, 2010 (EP) ..... 10194005

(51) Int. Cl.

| | |
|---|---|
| ***G04B 37/00*** | (2006.01) |
| ***G04C 9/00*** | (2006.01) |
| ***G04G 21/08*** | (2010.01) |

(52) U.S. Cl.

CPC ..... *G04G 21/08* (2013.01)

(58) Field of Classification Search

USPC ..... 368/276, 280, 309, 69, 187, 204

See application file for complete search history.

(56) References Cited

U.S. PATENT DOCUMENTS

| | | | | |
|---|---|---|---|---|
| 2,801,276 | A * | 7/1957 | Toce et al. | 429/120 |
| 4,048,796 | A | 9/1977 | Sasaki | |
| 4,059,956 | A | 11/1977 | Maeda et al. | |
| 4,073,132 | A * | 2/1978 | Frohlich | 368/204 |
| 4,090,353 | A * | 5/1978 | Maeda et al. | 368/188 |
| 4,533,256 | A * | 8/1985 | Ostendorf | 368/111 |

(Continued)

FOREIGN PATENT DOCUMENTS

| | | |
|---|---|---|
| CN | 1354401 A | 6/2002 |
| EP | 1 324 160 | 7/2003 |

(Continued)

OTHER PUBLICATIONS

International Search Report Issued Nov. 17, 2011 in PCT/EP11/68118 Filed Oct. 17, 2010.

Office Action issued Jun. 24, 2014, in Chinese Patent Application No. 2011800587119 (with English language translation).

*Primary Examiner* — Sean Kayes

(74) *Attorney, Agent, or Firm* — Oblon, McClelland, Maier & Neustadt, L.L.P.

(57) ABSTRACT

A wristwatch with capacitive touch zones including a case made of a non electrically conductive material, the case including a housing in which a battery is housed and which is closed by an electrically conductive battery cover. The electrically conductive battery cover is mounted on the watch case with interposition of an electrically conductive sealing gasket between the battery cover and the battery.

10 Claims, 1 Drawing Sheet

(56) References Cited

U.S. PATENT DOCUMENTS

| | | | | |
|---|---|---|---|---|
| 5,642,561 | A * | 7/1997 | Tuttle et al. | 29/623.2 |
| 7,136,138 | B1 * | 11/2006 | Sekiguchi et al. | 349/162 |
| 7,167,689 | B2 * | 1/2007 | Martin et al. | 455/90.3 |
| 2001/0014618 | A1 | 8/2001 | Martin et al. | |
| 2002/0060953 | A1 * | 5/2002 | Farine et al. | 368/69 |

FOREIGN PATENT DOCUMENTS

| | | |
|---|---|---|
| EP | 1 426 738 | 6/2004 |
| JP | 52092564 | 8/1977 |

* cited by examiner

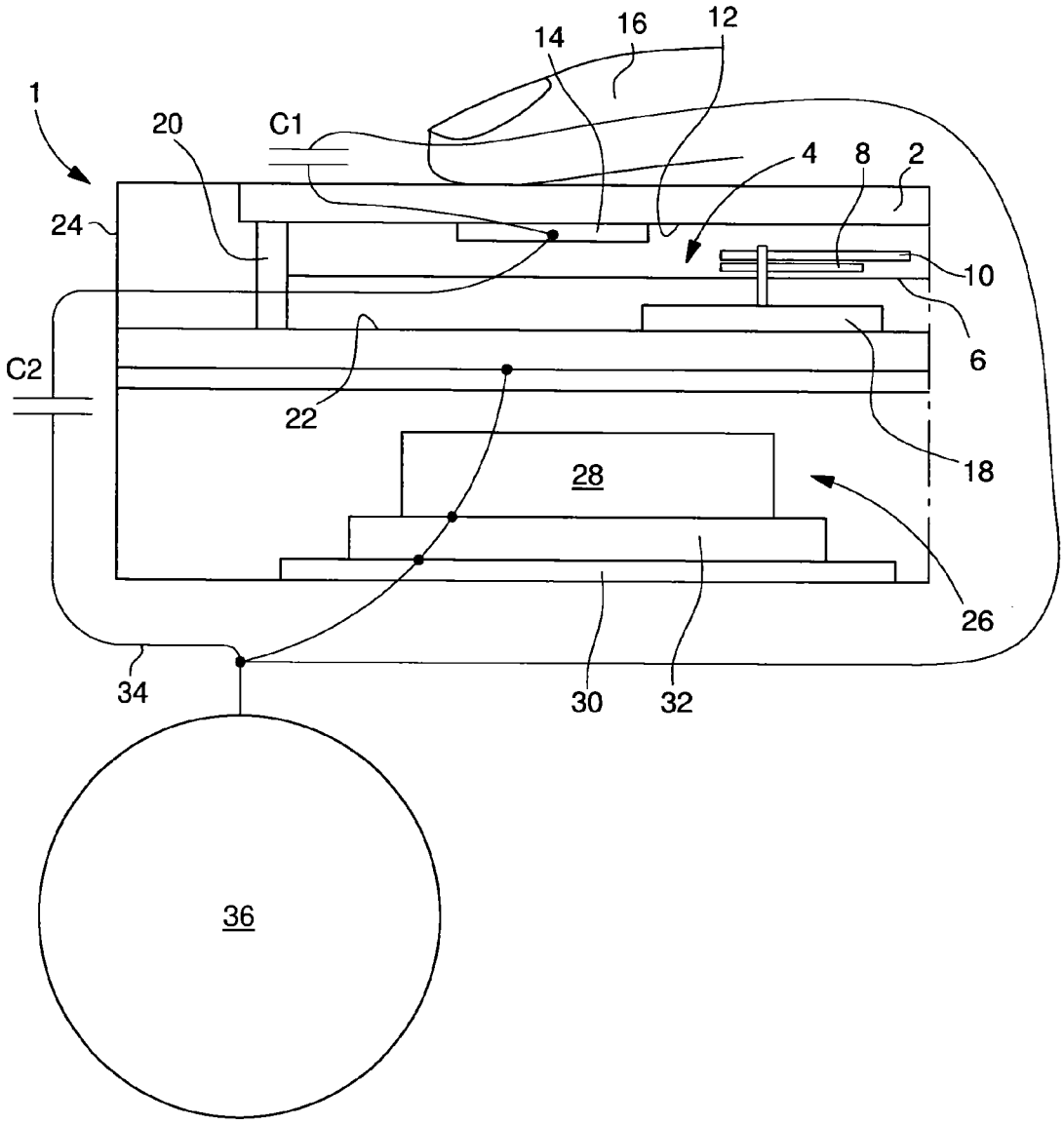
1
20
C1
14
16
12
4
8
2
24
10
6
C2
22
18
28
26
34
30
32
36

WATCH WITH TACTILE ZONES OF CAPACITIVE TYPE COMPRISING A BATTERY HATCH CLOSED BY AN ELECTRICALLY CONDUCTING COVER

CROSS-REFERENCE TO RELATED APPLICATIONS

This is a National Phase Application in the United States of International Patent Application PCT/EP 2011/068118 filed Oct. 17, 2011, which claims priority on European Patent Application No. 10194005.4 of Dec. 7, 2010. The entire disclosures of the above patent applications are hereby incorporated by reference.

The present invention concerns a timepiece of the wristwatch type with capacitive touch zones comprising a battery compartment closed by an electrically conductive battery cover. More specifically, the present invention concerns a watch of this type comprising a battery compartment closed by an electrically conductive cover which improves the operation of the watch.

A wristwatch with capacitive touch zones includes, in particular, a watch crystal made of transparent organic or mineral material arranged above a time indicator device. The time indicator device may be of the analogue type. In such case, it is formed by a dial above which, for example, hour and minute hands move. The time indicator device may also be of the digital type. In such case, it includes a display cell whose optical properties are altered by the application of an appropriate voltage or current. To form the touch zones, it is possible, for example, to structure electrodes made of transparent conductive material such as tin-indium oxide or "ITO" on the face of the crystal opposite the time indicator device, At rest, with the air from which they are separated by the watch crystal, the touch zones form the two armatures of a capacitor which has a certain capacitance value. This capacitance value is set by the sum of the various stray capacitances of the electronic system seen by an electrode forming a touch zone. This capacitance value will be altered when the user places his finger on the external surface of the crystal, on the electrode forming the selected touch zone. The effect of the finger is added to the stray capacitances and thus changes the total capacitance seen by the electronic control system of the watch. The electronic control system housed in the watch case will detect this variation in capacitance and deduce the corresponding instruction therefrom. In response to the introduction of this data, the electronic control circuit will perform the required operations.

It will be clear that, in order for a watch with capacitive touch zones to operate properly, the electronic watch system must detect as accurately as possible the variation in capacitance of the touch zone selected by the user who places his finger thereon. Depending on the type of material used to manufacture the watch, it may happen that the capacitance variation caused by the user placing his finger on the watch crystal is very small relative to the stray capacitance value and thus difficult to detect. Consequently, the electronic detection system of the watch is liable to be unable to detect the presence of the user's finger on the selected touch zone and does not perform the operation desired by the user, which is problematic.

In the case of a watch comprising a metal case, this problem does not arise since, by wearing the watch on his wrist, the user sets the electrical potential of his body to the inner reference potential known by the electronic system of the watch. Thus, when the user places a finger on the watch crystal, all the elements involved in detecting the variation in capacitance, including the person wearing the watch, are brought to the same potential which is the internal reference potential known by the electronic system of the watch. Indeed, these elements are included in a closed electrical loop which is formed between the user's right hand finger and left wrist. Consequently, all the elements are at the same internal reference potential of the electronic watch system, so that the additional capacitive effect caused by the user placing his finger on the touch key always has substantially the same value whatever the circumstances, which significantly improves the detection capacity of the electronic detection system of the watch.

The problem arises with watch cases made of a non-electrically conductive material such as plastic material. Indeed, in this case, the potential of the person wearing the watch is not set at the internal reference potential of the electronic watch system and is thus floating. Consequently, the potential of the person wearing the watch fluctuates considerably from one person to another and according to the circumstances at the time, so that the variation in capacitance caused by the user placing his finger on the watch crystal is not reproducible and situations may arise where the electronic watch system is not capable of detecting the presence of the wearer's finger on the touch key. To avoid this problem, one solution would consist for example in filling the plastic material with conductive particles. However, in this case, the conductive particles impart a dark colour to the plastic and deprive the watch designer of any freedom concerning the choice of colour for the watch case.

It is an object of the present invention to overcome the aforementioned drawbacks in addition to others by providing a wristwatch with capacitive touch zones comprising a means of setting the detection system and the wearer of the watch to the same potential.

The present invention therefore concerns a wristwatch with capacitive touch zones comprising a case made of a non electrically conductive material, said case including a battery compartment housing a battery and which is closed by an electrically conductive battery cover, the electrically conductive battery cover being mounted on the watch case with the interposition of an electrically conductive sealing gasket between the battery cover and an electrode of the battery.

As a result of these features, the present invention provides a wristwatch with tactile zones of the capacitive type whose case, although made of electrically non-conductive material, nonetheless allows all of the elements thereof, including the body of the person wearing the watch, involved in detecting the variation in capacitance of the touch zone, are brought to the same electrical potential. It is thus possible to prevent practically any fluctuation in value of the capacitance formed by the wearer of the watch placing his finger on the watch crystal on the desired touch key and consequently to ensure that the watch operates properly. Indeed, owing to the presence of the electrically conductive sealing gasket, when the user places his finger on the watch crystal, a closed loop is formed between the user's finger, the watch crystal, the touch zone on which the user's finger is placed, the printed circuit board on which the electronic control circuit of the touch zones is mounted, the battery, the battery cover with which the battery is in contact via the sealing gasket and the user's wrist with which the battery cover is in contact.

Other features and advantages of the present invention will appear more clearly from the following detailed description of an example embodiment of the watch with capacitive touch zones according to the invention, this example being given solely by way of non-limiting illustration with reference to the annexed drawing, in which the single FIGURE is a schematic, transverse, cross-section of a watch with capacitive touch zones fitted with a battery compartment according to the invention.

The present invention proceeds from the general inventive idea which consists in fitting the battery compartment of a watch with touch keys, whose case is made of a non-electrically conductive material, with an electrically conductive battery cover fitted with a sealing gasket made of a conductive material, such as a conductive particle filled elastomer so that, when the watch user places a finger on the watch crystal, all of the elements involved in detecting capacitance variation, including the user's body, are brought to the same electrical potential, which matches the internal reference potential of the electronic watch system. It is therefore possible to set the detection system and the wearer of the watch to the same electric potential, which significantly improves the capacity of the electronic watch system to detect the additional capacitive effect caused by the user placing a finger on the touch crystal and thus to guarantee that the watch operates properly.

The single Figure annexed to this Patent Application is a schematic, transverse cross-section of a wristwatch with capacitive touch zones according to the invention. Designated as a whole by the general reference number 1, this watch includes a transparent crystal 2 made of an organic or mineral material. This crystal covers an analogue time display device 4 comprising a dial 6 above which an hour hand 8 and a minute hand 10 move. At least one electrode forming a touch zone 14 is structured on the face 12 of watch crystal 2 opposite time display device 4. This touch zone 14 is made of a transparent electrically conductive material such as tin indium oxide (ITO).

With the air from which it is separated by watch crystal 2, touch zone 14 forms the two armatures of a capacitor C2 which has a certain capacitance value. This external capacitance value C2 is formed by all of the stray capacitances distributed around the electrode, both inside the watch (printed circuit 22, metal elements, motors, connectors and other elements) and outside (wearer's arm, environment).

The value of capacitance C2 is modified when the user places his finger 16 on watch crystal 2 on touch zone 14. This touch zone 14 is connected to an integrated control circuit 18 by means of a connector 20 which extends vertically between watch crystal 2 and a printed circuit board 22 on which the integrated control circuit 28 is mounted. Connector 20 is a "zebra" connector which only conducts electricity in the vertical direction.

When the user places a finger 16 on crystal 2 facing touch zone 14, he modifies the capacitance value C2 of touch zone 14. This capacitance variation is detected by integrated control circuit 18 which, in response to the introduction of this data, will carry out the corresponding operations.

In the case of a metal watch case, all the elements involved in detecting the capacitance variation of a touch zone, including the body of the person wearing the watch, are at the same electrical potential matching the internal reference potential of the electronic watch system. Indeed, these components form part of an electrical loop which is closed on the user's finger via the user's wrist. Consequently, all of the components are at the same electrical potential, which prevents any fluctuations in the additional capacitance value caused by the user's finger and significantly improves the efficiency of detection of the additional capacitance by the electronic watch system. The variation in capacitance seen by the detection system between the user's finger and the touch zone concerned is thus optimised, preventing any risk of the electronic control circuit failing to detect the presence of the user's finger.

The same is not true in the case of a watch with capacitive touch zones wherein the case is made of a non electrically conductive material such as a plastic material. Indeed, the case plays the part of an electrically insulating element and prevents the electrical loop between the finger, the various components involved in detecting the capacitance variation of the touch zone and the user's wrist closing on the user's finger. Consequently, the user's body which plays a part in detecting the capacitance variation is at a floating potential relative to the internal potential of the watch and the additional capacitive effect caused by the user's finger is difficult for the detection system to detect. To overcome this problem, one solution might consist in filling the plastic material with conductive particles. In this case however, the resulting plastic material would be dark coloured and the designer would have no freedom of choice as to the colour of the watch case.

According to the invention, case 24 of watch 1 includes a battery compartment 26 in which a battery 28 is housed. This battery compartment 26 is closed by an electrically conductive cover 30 with the interposition of a sealing gasket 32 made of an electrically conductive material between the electrically conductive cover 30 and the battery 28. This gasket 32, which seals battery compartment 26, also ensures the continuity of electric conduction between one of the terminals of battery 28 and the electrically conductive cover 30. The gasket 32 may, for example, be made of a conductive particle filled elastomer. The electrical contact between battery cover 30 and battery 28 may be further improved by arranging a layer of conductive grease between these two elements. The other terminal of battery 28 is connected to printed circuit board 22 for powering integrated control circuit 18 and touch zone 14.

Thus, owing to the present invention, all the elements involved in detecting the capacitance variation of a touch zone are included in a closed conductive loop between the user's finger and wrist. More specifically, electrically conductive sealing gasket 32 is used to close a loop 34 between the user's finger 16 placed on crystal 2 of watch 1, crystal 2, touch zone 14, integrated control circuit 18, battery 28, sealing gasket 32, battery cover 30 and the user's wrist 36. An electrical capacitance C2 is thus formed between the user's wrist 36, battery cover 30, sealing gasket 32, battery 28, printed circuit board 22, electrical connector 20, touch zone 14 and crystal 2 of watch 1. Since all these elements are set at the same electrical potential, this significantly improves the additional capacitive effect C1 caused by the user's finger and thus optimises the variation in capacitance value picked up by the detection system. This therefore prevents any erroneous interpretation of fluctuations in capacitance by the integrated control circuit of the watch.

The invention claimed is:

1. A wristwatch comprising:

capacitive touch zones; and a case made of a non-electrically conductive material, wherein the case includes a housing in which a battery is housed and which is closed by an electrically conductive battery cover, wherein the electrically conductive battery cover is mounted on the watch case with interposition of an electrically conductive sealing gasket between the electrically conductive battery cover and one of terminals of the battery, and the electrically conductive battery cover is configured to be in contact with a user's wrist skin, so that a body of the user, the electrically conductive battery cover, the sealing gasket, the battery, and the capacitive touch zones are at a same electrical potential during detection of a capacitive variation of the capacitive touch zones.

2. The wristwatch according to claim 1, wherein the battery cover is made of an electrically conductive metallic material.

3. The wristwatch according to claim 2, wherein the sealing gasket is made of an elastomeric material filled with conductive particles.

4. The wristwatch according to claim 3, further comprising a layer of conductive grease arranged between the battery cover and the sealing gasket.

5. The wristwatch according to claim 2, further comprising a layer of conductive grease arranged between the battery cover and the sealing gasket.

6. The wristwatch according to claim 1, wherein the sealing gasket is made of an elastomeric material filled with conductive particles.

7. The wristwatch according to claim 6, further comprising a layer of conductive grease arranged between the battery cover and the sealing gasket.

8. The wristwatch according to claim 1, further comprising a layer of conductive grease arranged between the battery cover and the sealing gasket.

9. The wristwatch according to claim 1, wherein the capacitive touch zones are electrically connected to an integrated control circuit by a connector including alternating conductive and nonconductive vertical layers.

10. A wristwatch comprising:

a capacitive touch zone; and a case made of a non-electrically conductive material, wherein the case includes a housing in which a battery is housed and which is closed by an electrically conductive battery cover, wherein the electrically conductive battery cover is mounted on the watch case with interposition of an electrically conductive sealing gasket between the electrically conductive battery cover and one of terminals of the battery, and the electrically conductive battery cover is configured to be in contact with a user's wrist skin, so that a body of the user, the electrically conductive battery cover, the sealing gasket, the battery, and the capacitive touch zone are at a same electrical potential during detection of a capacitive variation of the capacitive touch zone.

* * * * *